US006256551B1

(12) United States Patent
Muto

(10) Patent No.: US 6,256,551 B1
(45) Date of Patent: Jul. 3, 2001

(54) EMBROIDERY DATA PRODUCTION UPON PARTITIONING A LARGE-SIZE EMBROIDERY PATTERN INTO SEVERAL REGIONS

(75) Inventor: Yukiyoshi Muto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/141,619

(22) Filed: Aug. 27, 1998

(30) Foreign Application Priority Data

Aug. 27, 1997 (JP) ..... 9-231038

(51) Int. Cl.[7] ..... G06F 19/00; D05B 21/00

(52) U.S. Cl. ..... 700/138; 700/135; 700/138; 112/102.5; 112/457

(58) Field of Search ..... 700/17, 136, 137–144, 700/130–135; 112/470.4, 457, 277, 102.5, 80.23

(56) References Cited

U.S. PATENT DOCUMENTS 5,386,789 * 2/1995 Futamura et al. ..... 112/102.5
5,438,520 8/1995 Satoh et al. ..... 700/132
5,558,032 * 9/1996 Muto et al. ..... 112/102.5
5,899,154 * 5/1999 Mizuno ..... 112/102.5
5,911,181 * 6/1999 Muto ..... 112/102.5
6,004,018 * 12/1999 Kawasato et al. ..... 700/138

FOREIGN PATENT DOCUMENTS 4-348791 12/1992 (JP) .
5-337266 12/1993 (JP) .
7-250983 10/1995 (JP) .

* cited by examiner

*Primary Examiner*—William Grant
*Assistant Examiner*—Kidest Bahta
(74) *Attorney, Agent, or Firm*—Oliff & Berridge, PLC

(57) ABSTRACT

A large embroidery pattern is divided into a plurality of sewing regions so that each sewing region does not exceed the maximum sewing size of an embroidery sewing machine. An embroidery data processor prepares a piece of embroidery data for each divided embroidery pattern. The embroidery sewing machine separately sews a plurality of partial embroideries corresponding to partial embroidery patterns in separate pieces of cloth. The separate pieces of cloth can be arranged and sewn together to reproduce embroidery in the original size of the original overall embroidery pattern.

33 Claims, 10 Drawing Sheets

SEWING REGION MEMORY 34

| | | | | |
|---|---|---|---|---|
| SEWING REG. R1 | SEWING REG. R2 | SEWING REG. R3 | SEWING REG. R4 | ... |

EMB. DATA MEMORY 33

| | | | | |
|---|---|---|---|---|
| EMB. DATA D1 | EMB. DATA D2 | EMB. DATA D3 | EMB. DATA D4 | ... |

EMBROIDERY DATA PRODUCTION UPON PARTITIONING A LARGE-SIZE EMBROIDERY PATTERN INTO SEVERAL REGIONS

BACKGROUND OF THE INVENTION

1. Field of the Invention

The present invention relates to an embroidery data processor for preparing embroidery data based on figure data of an embroidery figure. The present invention further relates to a recording medium that stores an embroidery data processing program that can be retrieved by a computer.

2. Description of the Related Art

Embroidery data preparation devices have been known, for example, in the industrial sewing machine field, for enabling simple preparation of embroidery data based on figure data of an embroidery figure. One such embroidery data preparation device is configured from a general purpose personal computer system, and an image scanner, a hard disk, a keyboard and a cathode ray tube (CRT) display connected to the computer system.

When preparing embroidery data using this embroidery data preparation device, first, figure data that represents a figure is retrieved from where it is prestored in a hard disk. Alternatively, figure data representing an embroidery pattern could be extracted from pattern image data, which was retrieved by scanning a hand drawn embroidery figure or a printed image with the image scanner. The figure data is inputted into the personal computer system.

Here, an explanation will be provided for an embroidery sewing machine in which embroidery data prepared by embroidery data preparation device is used to sew embroidery patterns. As shown in FIG. 11, the embroidery sewing machine includes a sewing frame 12 and a needle 13. The sewing frame 12 supports a cloth in which the embroidery pattern is to be sewn using the needle 13. The embroidery sewing machine is capable of sewing in a maximum sewing range "a" having a width W and a height H.

After figure data is prepared, a mask "b" is designated. As shown in FIG. 11, the mask "b" is a rectangular sewing region positioned within the maximum sewing range "a". This mask "b" serves as a reference on which embroidery data supplied to the embroidery sewing machine is based. That is, the embroidery data includes the mask size, that is, the length and width of the mask "b", and stitch position data represented by coordinates, wherein the origin of the coordinates is the upper left point of the mask "b".

The embroidery data supplied from the personal computer is laid out to position the center of the mask "b" at the center of the embroidery frame 12. Then embroidery is sewn in the cloth based on the stitch position data. When embroidering with an embroidery sewing machine based on such embroidery data, the state of the mask "b" must be designated so as not to exceed the size, that is, the width W and height H, of the maximum sewing range "a" of the embroidery sewing machine.

Conventionally, embroidery data that fits within a region surrounded by the contour line is prepared based on figure data and on a mask that encompasses the figure. When the figure is a linear figure, then, based on figure data and on a mask that encompasses the linear figure, embroidery stitches for stitching the linear figure are prepared and then embroidery data, wherein the embroidery stitches fit within the mask, is prepared.

When embroidery data prepared using the above-described processes is for a large figure, then the mask that encompasses the large figure will also be large. However, embroidery can not be sewn if the mask exceeds the maximum sewing size of the sewing machine. An example will be provided while referring to FIG. 6. FIG. 6 shows a large "shooting star" figure. Because the "shooting star" figure is larger than the maximum sewing size "a" of the sewing machine, the smallest rectangle that encompasses all the figure data for the "shooting star" figure will also exceed the maximum sewing size "a". Accordingly, the embroidery sewing machine will be unable to sew the "shooting star" figure using figure data prepared with this smallest rectangle as the mask. the overall "shooting star" figure could be broken into components, that is, the polygonal star shape and the three "shooting" lines, and a separate mask used for preparing figure data for each component. However, the star shape would still require a mask that is larger than the maximum sewing size of the embroidery sewing machine, so that in the end the figure data representing the star shape could still not be used by the embroidery sewing machine.

SUMMARY OF THE INVENTION

It is an object of the present invention to overcome the above-described problems and to provide an embroidery data processor for preparing embroidery data based on figure data representing an embroidery pattern. An embroidery sewing machine forms an embroidery based on the embroidery data prepared by the embrodiery data processor. The embroidery sewing machine has a maximum sewing size. The term "embroidery pattern" as used herein means at least one of a contour line of a planar figure and a line of a linear figure. The embroidery data is for sewing the embroidery by, for example, filling the planar figure with embroidery stitches.

The embroidery data processor in accordance with the present-invention includes sewing region setting means for setting size of a sewing region so that the sewing region does not exceed the maximum sewing size of the embroidery sewing machine; embroidery data preparation means is also provided for preparing a piece of embroidery data corresponding to a partial embroidery pattern encompassed by the sewing region set by said sewing region setting means; and embroidery data storage means for storing the piece of embroidery data.

If the sewing size of an overall embroidery pattern exceeds the maximum sewing size of the embroidery sewing machine, then the sewing machine will be unable to use embroidery data that is prepared for filling in the overall embroidery pattern with embrodiery stitches. However, according to the present invention, the overall embroidery pattern is divided into partial patterns so as to be encompassed by sewing regions, each of which is set to a size that does not exceed the maximum size of the sewing machine. Then, a piece of embroidery data is prepared for the partial embroidery pattern and the embroidery sewing machine sews embroidery that fills in the partial embroidery pattern with embroidery stitches based on the piece of embroidery data.

The sewing region setting means sets at least two sewing regions so that size of each sewing region does not exceed the maximum sewing size of the sewing machine. The embroidery data preparation means prepares, for each sewing region, a corresponding piece of embroidery data corresponding to a partial embroidery pattern encompassed by a corresponding sewing region. The embroidery data storage means stores at least two pieces of embroidery data in different storage regions.

In this way, a plurality of sewing regions are set to cover an overall embroidery pattern represented by figure data. In other words, even large embroidery patterns can be covered by using a plurality of sewing regions. In more detail, first plural pieces of embroidery data are prepared based on partial embroidery patterns formed by dividing the overall embroidery pattern based on the sewing regions. Then, embroidery sewing machine uses these plural pieces of embroidery data to sew embroidery for each partial embroidery pattern in a separate piece of cloth. Afterward, the separate pieces of cloth can be arranged and sewn together to reproduce embroidery in the original size of the original overall embroidery pattern.

In the present invention, each sewing region has an overlapping section that overlaps an adjacent sewing region. Specifically, each of the plurality of sewing regions can be formed to include sections that overlap with adjacent sewing regions. In this case, when the separate pieces of cloth, each embroidered with a partial embroidery pattern, are arranged and sewn together, no gaps will appear between adjacent partial embroidery patterns of the overall embroidery pattern.

In the present invention, the figure data represents at least one of a contour line of a planar embroidery pattern and a line of a linear embroidery pattern. In this case, the partial embroidery patterns formed by dividing the overall embroidery pattern with a sewing region can also include planar embroidery patterns defined by contour lines, linear embroidery patterns defined by line shapes, or both. Therefore, embroidery data used for filling in a variety of partial embroidery patterns with embroidery stitches can be easily prepared using well known embroidery data preparation techniques for preparing embroidery data based on the contour lines or the line shapes.

According to another aspect of the present invention, there is provided an embroidery data processor including determining means for determining size of the embroidery pattern; divided means for dividing the embroidery pattern into a plurality of sewing regions based on the maximum sewing size so that each of the plurality of sewing regions does not exceed the maximum sewing size; pattern recognition means for recognizing a piece of embroidery pattern encompassed by each of the plurality of sewing regions; developing means for developing the piece of embroidery pattern recognized by said pattern recognition means into a piece of embroidery data; and embroidery data storage means for storing the piece of embroidery data developed by said developing means.

Preferably, the size of the embroidery pattern can be represented by a size of a rectangle that encompasses the embroidery pattern. The determining means may determine the size of the embroidery pattern so as to be a size larger than a minimum size of a rectangle that encompasses the embroidery pattern. It is preferable to determine the size of the embroidery pattern on an x–y coordinate system.

The dividing means divides the embroidery pattern so that each of the plurality of sewing regions has an overlapping section that overlaps an adjacent sewing region.

The present invention also provides a method of operating the embroidery data processor. With the method, the embroider data processor functions as described above. The present invention further provides a storage medium that stores a program of operating the embroidery data processor. When the embroidery data processor is run with the program supplied by the storage medium, it operates as described above.

BRIEF DESCRIPTION OF THE DRAWINGS

The above and other objects, features and advantages of the invention will become more apparent from reading the following description of the preferred embodiment taken in connection with the accompanying drawings in which:

FIG. 8(*b*) is a schematic view showing partial figure data obtained by clipping the figure data based on the sewing region R4 shown in FIG. 7;

FIG. 8(*c*) is a schematic view showing partial figure data obtained by clipping the figure data based on the sewing region R1 shown in FIG. 7;

FIG. 8(*d*) is a schematic view showing partial figure data obtained by clipping the figure data based on the sewing region R2 shown in FIG. 7;

FIG. 9(*b*) is a schematic view showing embroidery data prepared from the partial figure data shown in FIG. 8(*b*);

FIG. 9(*c*) is a schematic view showing embroidery data prepared from the partial figure data shown in FIG. 8(*c*);

FIG. 9(*d*) is a schematic view showing embroidery data prepared from the partial figure data shown in FIG. 8(*d*);

FIG. 10(*b*) is a schematic view showing an embroidery region memory; and

DETAILED DESCRIPTION OF THE PREFERRED EMBODIMENTS

An embroidery data processor according to a preferred embodiment of the present invention will be described while referring to the accompanying drawings.

The present embodiment is directed to an embroidery data processor that prepares embroidery data for use in a household embroidery sewing machine. First, figure data is inputted into a personal computer system by retrieving the figure data from where it is prestored in a hard disk. Alternatively, figure data representing an embroidery pattern could be extracted from pattern image data, which was retrieved by scanning a hand drawn embroidery pattern or a printed original image with the image scanner. Embroidery data for sewing embroidery stitches on the line shapes, in the region encompassed by the contour line, and the like of the original image is prepared based on the inputted figure data. Next, the embroidery data is written in a flash memory card so that the embroidery data can be supplied to the household embroidery sewing machine.

Figure 1:
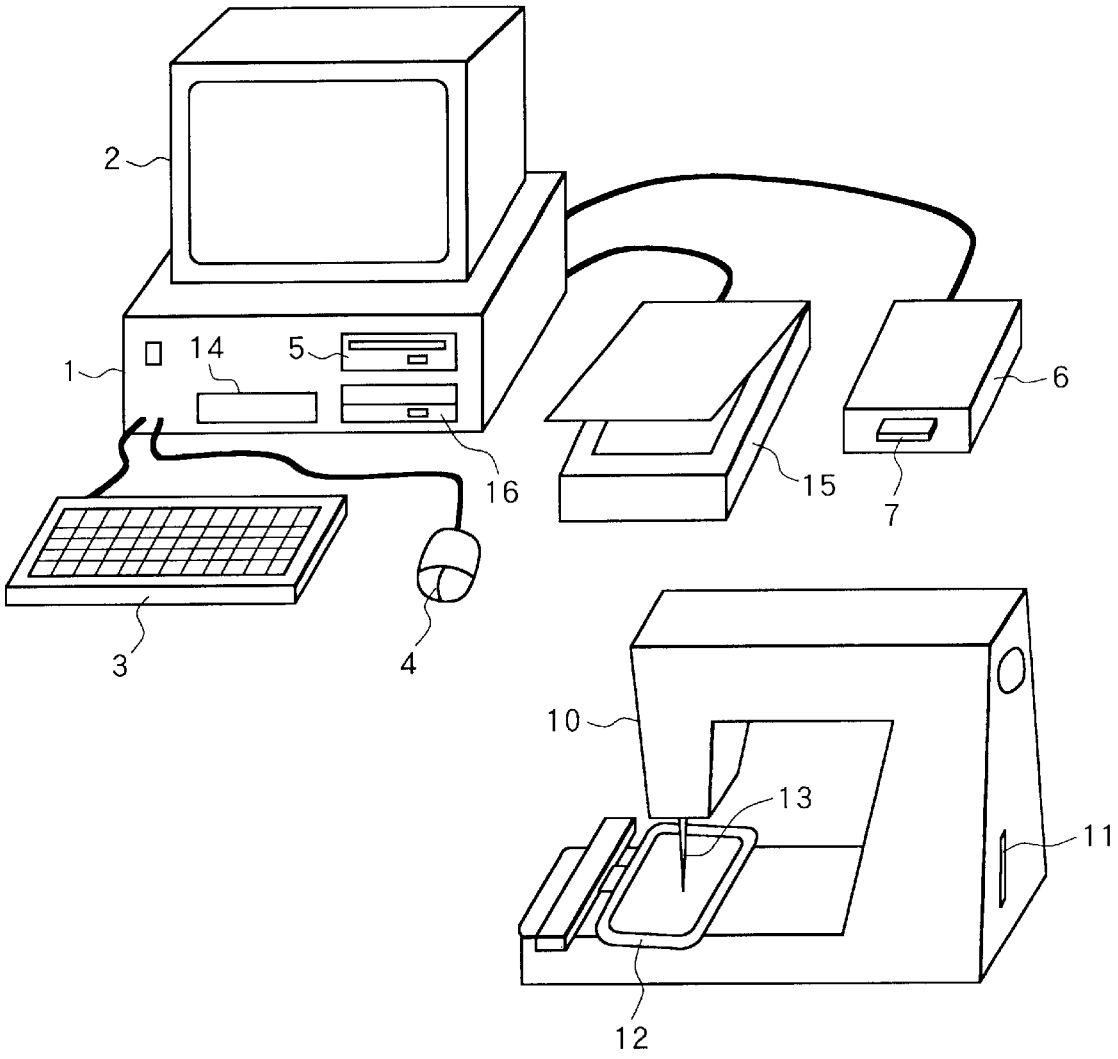
FIG. 1 is a perspective view showing an embroidery data processor and an embroidery sewing machine according to an embodiment of the present invention.

As shown in FIG. 1, the embroidery data processor basically includes a cathode ray tube (CRT) display 2 for displaying images, figures, characters, and the like; a keyboard 3 and a mouse 4 for inputting points and enabling a user to select options from menus; a floppy disk drive 5 and a hard disk drive 14 for performing storage and retrieval of image data, figure data, and embroidery data; a CD-ROM drive 16 for retrieving image data, figure data, and embroidery data; a flash memory drive 6 for writing embroidery data onto a detachable memory card 7 formed from a volatile flash memory; an image scanner 15 for retrieving original figures; and a control unit 1 connected to these other components.

A household sewing machine 10 includes an embroidery sewing frame 12 and sewing needle 13, which is disposed on a needle bar (not shown). The sewing frame 12 is disposed on the sewing machine bed and is for supporting a workpiece cloth. Although not shown in the drawings, the sewing machine 10 also includes a loop taker mechanism and a horizontal movement mechanism. The horizontal movement mechanism is for moving the sewing frame 12 horizontally based on an x–y coordinate system peculiar to the sewing machine 10. The sewing machine 10 embroiders predetermined patterns in the workpiece cloth by moving the sewing frame 12 to predetermined positions base don the x–y coordinate system while at the same time driving the shuttle mechanism and the sewing needle 13 to sew.

During these embroidery sewing operations, the horizontal movement mechanism and the needle bar are controlled by a control device configured from a microcomputer, for example. The control device can automatically execute embroidery operations when provided with data indicating stitch positions, that is, movement amounts in the x and y directions of the workpiece cloth for each stitch. The sewing machine 10 includes a flash memory 11 so that embroidery data can be supplied from an external source using the memory card 7. The embroidery data processor according to the present embodiment is capable of preparing embroidery data that such an embroidery sewing machine 10 can be used to sew embroideries.

Figure 2:
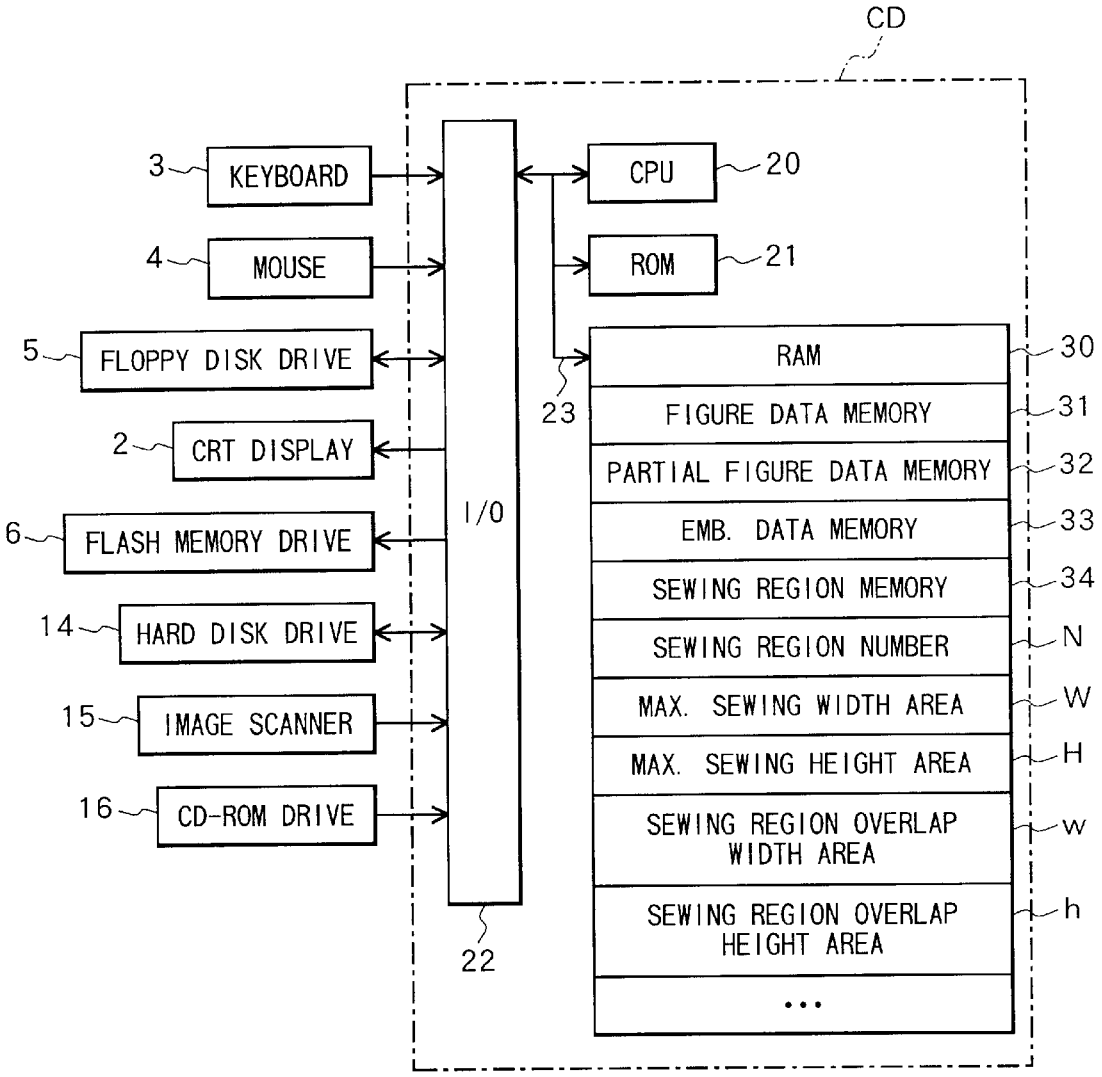
FIG. 2 is a block diagram showing an electrical control system of the embroidery data processor of FIG. 1.

Next, the control system of the embroidery data processor will be described while referring to the block diagram shown in FIG. 2. A control device CD is provided internally in the control unit 1. The control device CD includes an input/output interface 22 connected to the CRT display 2, the keyboard 3, the mouse 4, the floppy disk drive 5, flash memory drive 6, the hard disk drive 14, the image scanner 15, and the CD-ROM drive 16.

The control device CD is configured from a CPU 20; the input/output interface 22, which is also connected to the CPU 20 via a bus 23, such as a data bus; a ROM 21; and a RAM 30. The ROM 21 stores control programs of an embroidery data preparation routine and a sewing region setting routine to be described later.

The RAM 30 includes a variety of memories including a figure data memory 31 storing figure data representing contour lines of planar figures, line shapes of linear figures, or both; a partial figure data memory 32 for storing data representing partial embroidery patterns formed when an overall embroidery pattern is divided; an embroidery data memory 33 storing a plurality of embroidery data sets: and a sewing region memory 34 storing a plurality of sewing regions. The RAM 30 also includes memory areas for storing a variety of different values, such as a sewing region number area N for storing a number N; a maximum sewing width area W for storing a maximum sewing width W at which the sewing machine can sew in a lateral direction; a maximum sewing height area H for storing a maximum sewing height H in which the sewing machine can sew in; a width overlap area w for storing a sewing region overlap width w at which adjacent sewing regions overlap in the lateral direction; and a height overlap area h for storing an overlap height h at which adjacent sewing regions overlap in the longitudinal direction.

Before processes are performed for preparing embroidery data, the maximum sewing width W, maximum sewing height H, the sewing region overlap width w, and the sewing region overlap height h are stored in the ROM 30 in the maximum sewing width area W, the maximum sewing height area H, the width overlap area w and the height overlap area h, respectively. The maximum sewing width W, maximum sewing height H, the sewing region overlap width w, and the sewing region overlap height h can be prestored and retrieved from the ROM 21, the floppy disk 5, the hard disk 14, or the CD-ROM 16.

Figure 3:
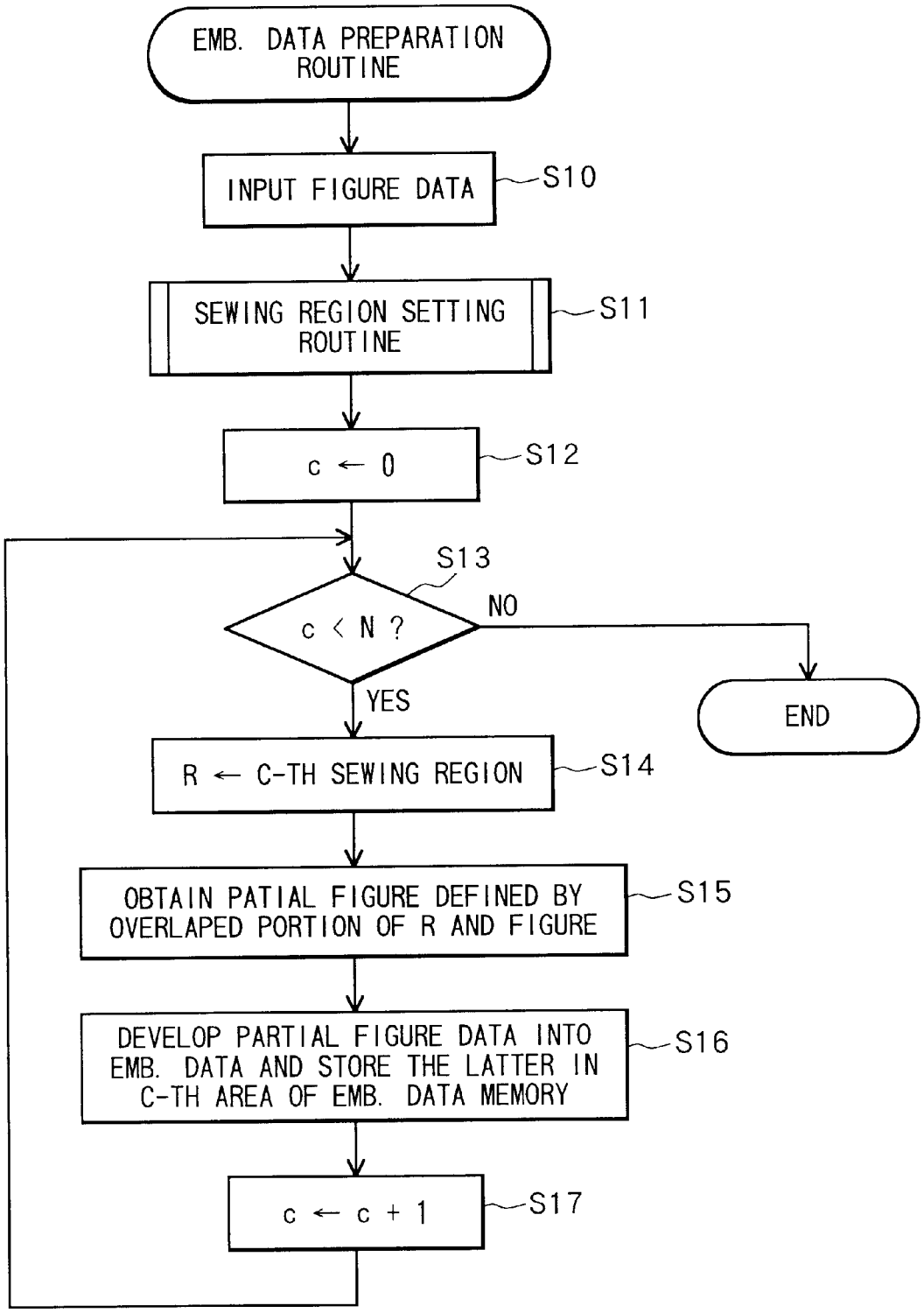
FIG. 3 is a flowchart representing an embroidery data preparation routine used in the embroidery data processor.
Figure 4:
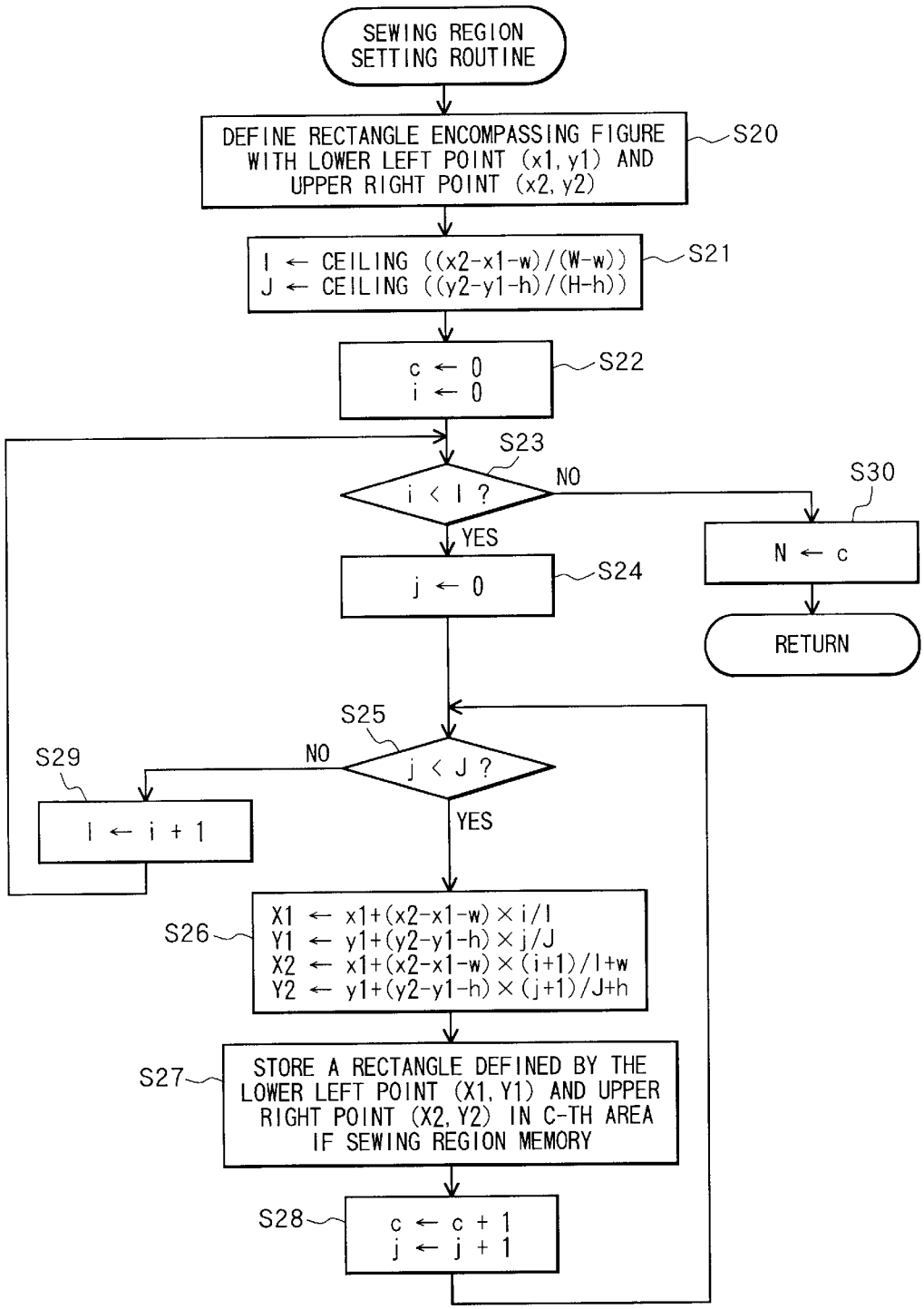
FIG. 4 is a flow chart representing a sewing region setting routine performed in the embroidery data preparation routine represented by the flowchart of FIG. 3.

Next, an embroidery data preparation routine performed by the control device CD of the embroidery data processor will be described while referring to the flowcharts shown in FIGS. 3 and 4. It should be noted that in the flowcharts, individual steps are indicated by Si, wherein 1 indicates the number of the individual step, such as S10, S11, S12 . . . S1.

This routine is started by manipulating specified keys on the keyboard 3. First, in S10, figure data is stored in the figure data memory 31. The figure data represents contour lines of planar figures and line shapes of linear figures. The figure data can be prestored in a recording medium such as the floppy disk, the hard disk, or the CD-ROM and retrieved therefrom in S10. Alternatively, the image scanner 15 scans across a hand drawn or printed original image to retrieve pattern image data. In this case, the figure data representing an embroidery pattern or a figure can be extracted from the pattern image data.

Figure 5:
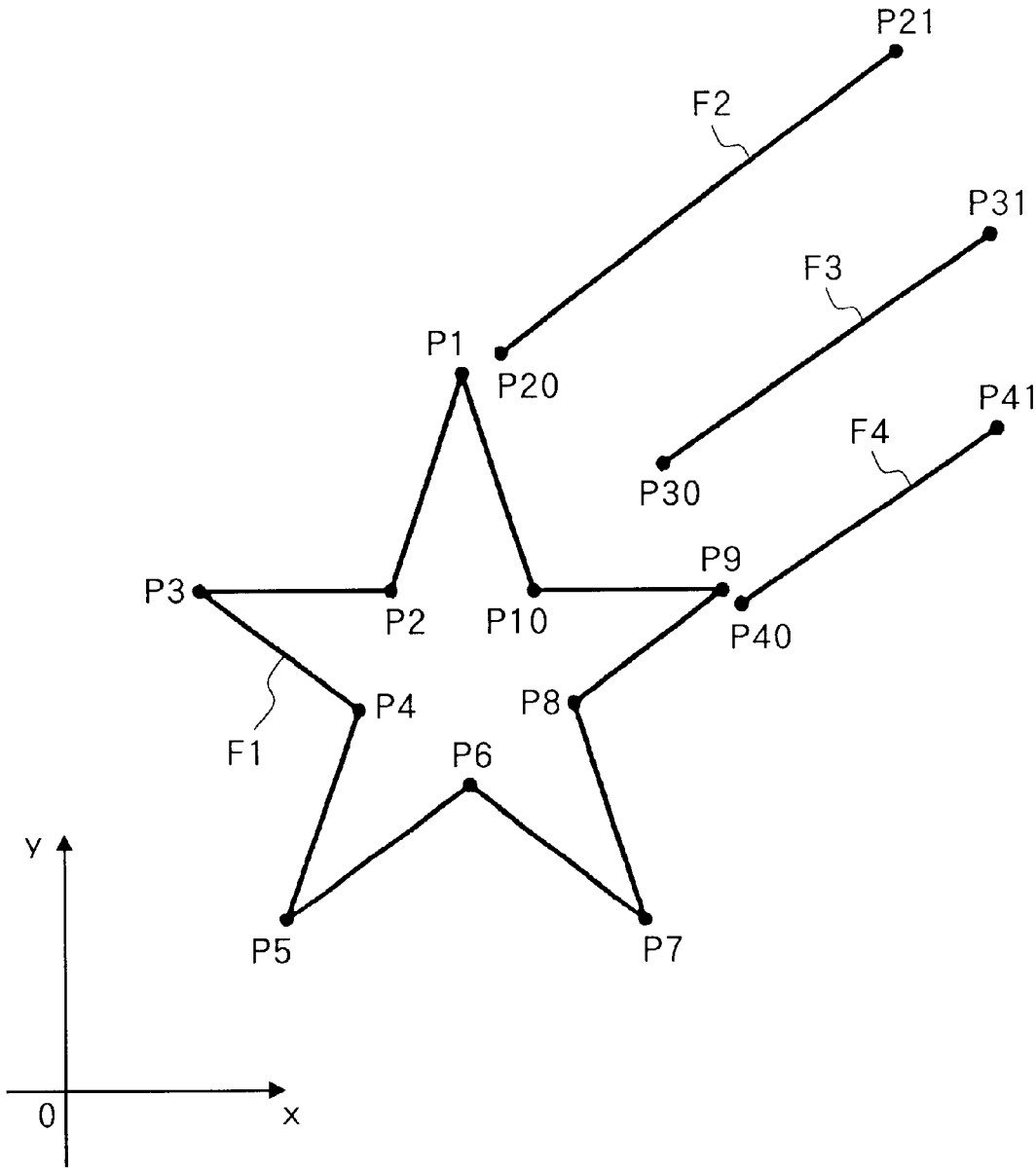
FIG. 5 is a schematic view showing an example of figure data subjected to processes of the embroidery data processor.
Figure 6:
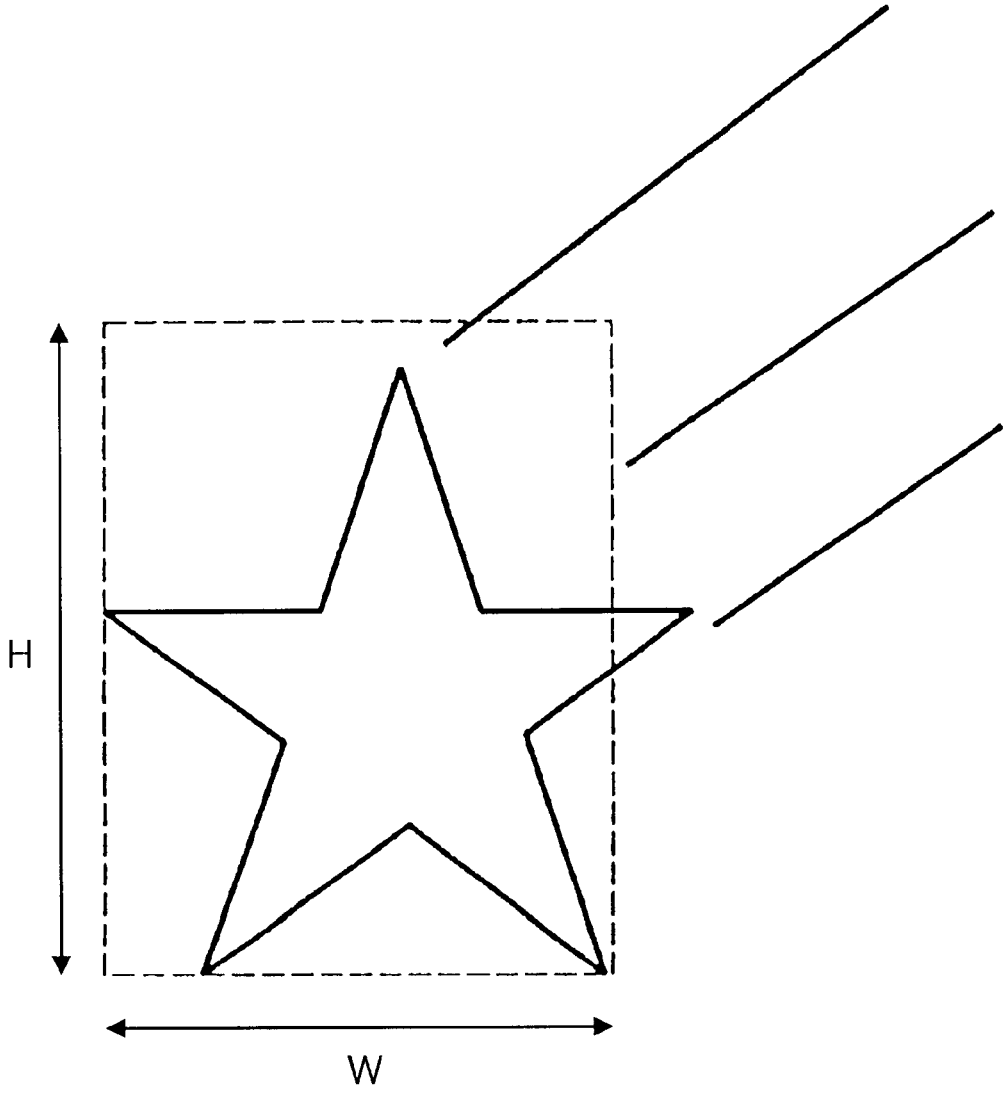
FIG. 6 is a schematic view comparing the figure data of FIG. 5 with a maximum sewing site of the embroidery sewing machine.

For example, in S10 the figure data shown in FIG. 5 is inputted. The figure data shown in FIG. 5 is configured from component figures F1 to F4, wherein the component figure F1 is a polygonal star shaped defined by points P1 to P10, the component figure F2 is a line segment defined by points P20 and P21, the component figure F3 is a line segment defined by points P30 and P31, and the component figure P4 is a line segment defined by points P40 and P41.

Next, a sewing region setting routine is performed in S11. The sewing region setting routine is represented by the flowchart shown in FIG. 4. When the sewing region setting routine is started, first in S20, coordinates of the smallest rectangle that encompasses the figure is obtained, wherein the lower left point of the rectangle has the coordinates of (x1, y1) and the upper right point of the rectangle has the coordinates of (x2, y2). From the coordinates of the two points, maximum and minimum values are determined from x and y coordinates of points defining the contours or line shapes of the subject figure. The sewing region can be set to cover the rectangle encompassing the figure. Therefore, the coordinates x1 of the sewing region is set to a value equal to or less than the smallest x coordinate value of the rectangle. Likewise, the coordinate y1 of the sewing region is set to value equal to or less than the smallest y coordinate value of the rectangle. The coordinate x2 of the sewing region is set to a value equal to or greater than the largest x coordinate value of the rectangle, and the coordinate y2 is set to a value equal to or greater than the largest y coordinate value of the rectangle.

Next, variables I and J, which indicate the total number of times the rectangle encompassing the subject figure is to be divided in the x direction and in the y direction, respectively, are set in S21 based on the following formulas:

$$I=\text{ceiling}\ ((x2-x1-w)/(W-w));$$

$$J=\text{ceiling}\ ((y2-y1-h)/(H-h).$$

wherein ceiling (x) is a calculation to give the smallest integer that is not smaller than the real number x;

W is the maximum sewing width of the sewing machine;

H is the maximum sewing height of the sewing machine;

w is the sewing region overlap width; and h is the sewing region overlap height.

Next in S22, a sewing region counter c, which represents a subject sewing region, that is, a sewing region presently under consideration, and an x direction sewing region counter 1, which represents the number in the x direction of the subject sewing region, are both set to 0. Then, in S23 it is determined whether or not the value in the x direction sewing region counter i is less than the total number of x direction sewing regions I. If so (S23:YES), then the values of a y direction sewing region counter j is set to 0 in S24.

Next, in S25 it is determined whether or not the value in the y direction sewing region counter j is greater than the total number of y direction sewing regions J. If so (S25:YES), then the program proceeds to S26. In S26, values X1, X2, Y1, and Y2 are determined for use in S27 to determine coordinates of the lower left point (X1, Y1) and the upper right point (X2, Y2). The values X1, X2, Y1, and Y2 are determined in S26 based on the following formulas:

$$X1=x1+(x2-x1-w)\times i/I;$$

$$Y1=y1+(y2-y1-h)\times j/J;$$

$$X2=1+(x2-x1-w)\times(x+1)/I+w;\ \text{and}$$

$$Y2=y1+(y2-y1-h)\times(j+1)/J+h.$$

Next in S27, a rectangle defined by the lower left point (X1, Y1) and the upper right point (X2, Y2) is stored in the c-th area of the sewing region memory 34. Then, in S28, the values in the counters c and j are both incremented by one and the program returns to S25. If it is determined in S25 that the value in the counter j is not less than the value of the variable J (S25:NO), this means that coordinates for upper right and lower left points have been determined for present column of cells. Therefore, the value of the counter i is incremented by one in S29 so that coordinates can be determined for upper right and lower left points of sewing regions in the next column of sewing regions. Then, the program returns to S23. If in S23, it is determined that the value in counter i is not less than the variable I (S23:NO), then this means that all the rows of cells have been investigated. Therefore, in S30 the total sewing region number is set to the value in the counter c and the sewing region setting routine is ended. Afterward, the program returns to S11 of the flowchart shown in FIG. 3.

Assuming that coordinates x3, x4, y3, and y4 of the figure data shown in FIG. 5 have the following values:

$$x3=x1+(x2-x1-w)/2$$

$$x4=x1+(x2-x1-w)/2+w$$

$$y3=y1+(y2-y1-h)/2$$

$$y4=y1+(y2-y1-h)/2+h$$

Figure 7:
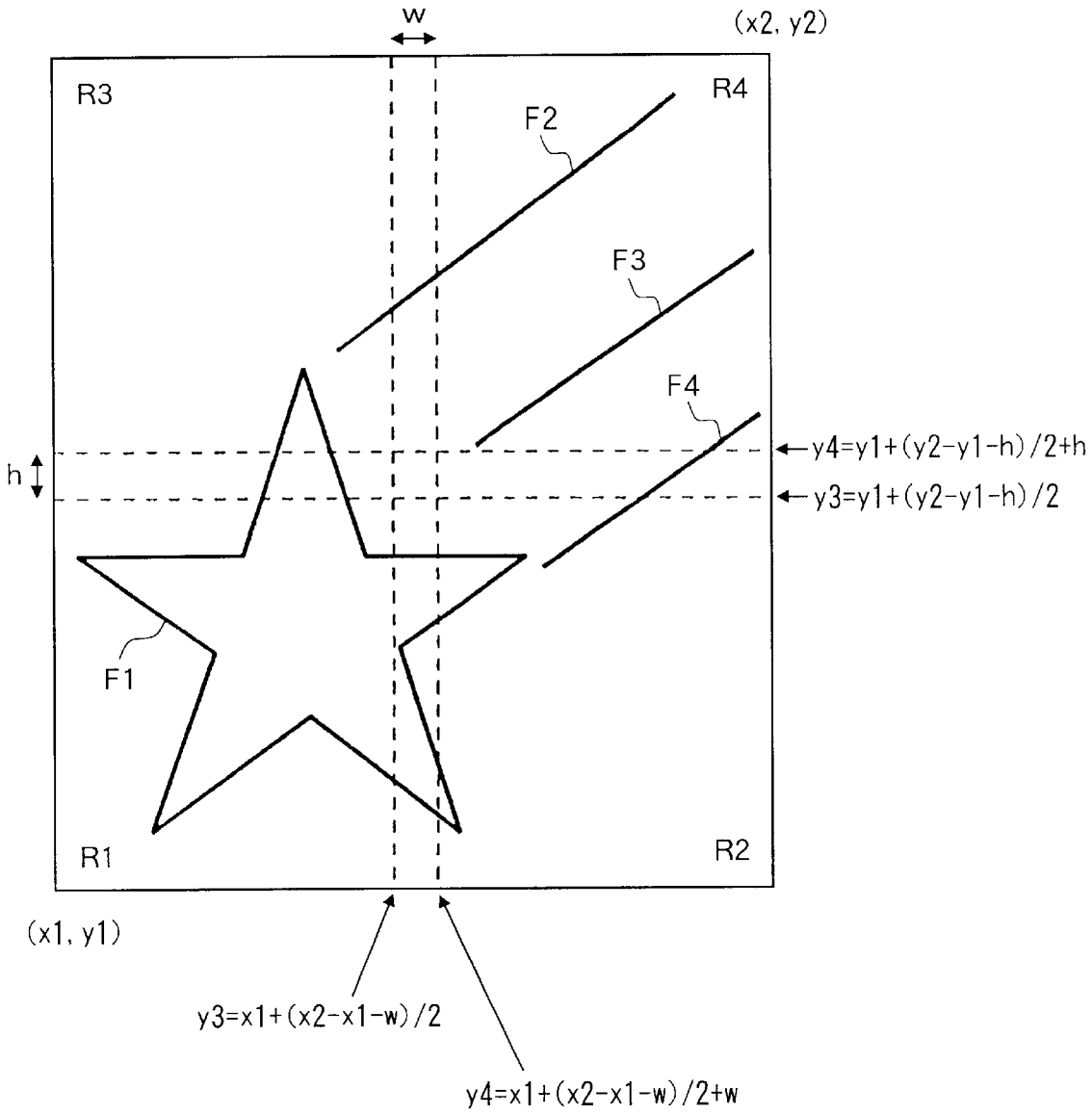
FIG. 7 is a schematic view showing the figure data of FIG. 5 divided by sewing regions R1 to R4, which are determined based on the maximum sewing size of the embroidery sewing machine.
Figures 10, 11:
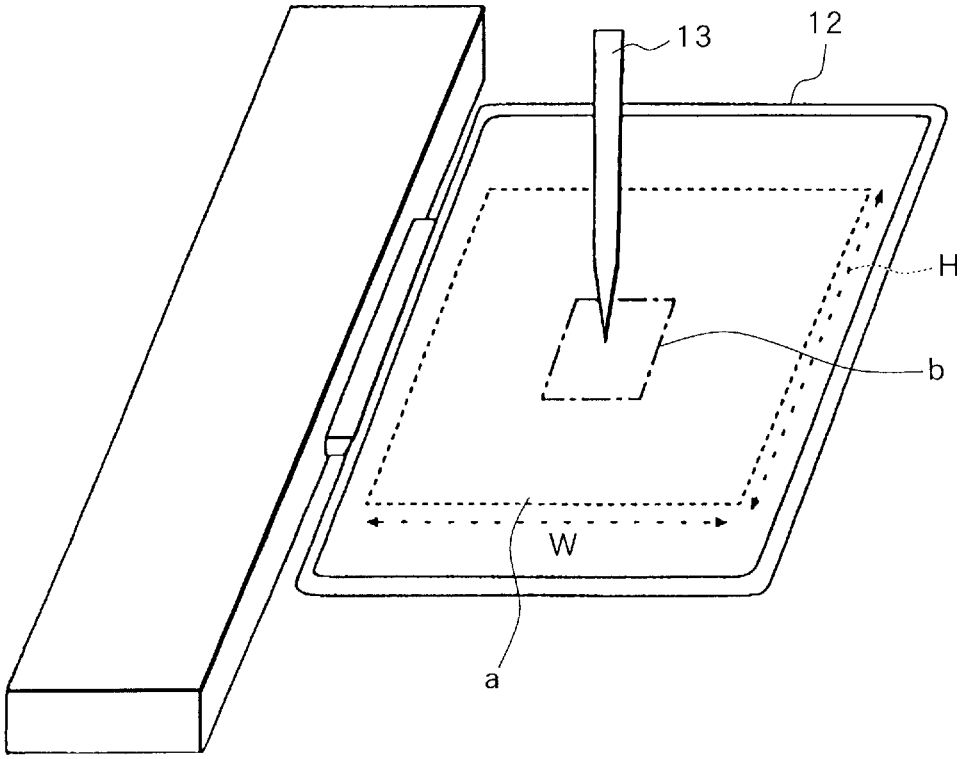
FIG. 10(*a*) is a schematic view showing a sewing region memory.
FIG. 11 is a perspective view showing positional relationship between a mask and a maximum sewing region of embroidery sewing machine.

Then, the sewing region setting routine will prepare data for the four rectangles R1 to R4 shown in FIG. 7 and as indicated below, and will store the data in the sewing region memory 34 as shown in FIG. 10(*a*):

R1: lower left (x1, y1), upper right (x4, y4)

R2: lower left (x3, y1), upper right (x2, y4)

R3: lower left (x1, y3), upper right (x4, y2)

R4: lower left (x3, y3), upper right (x2, y2)

When the sewing region setting routine of S11 is completed, then the value in the sewing region counter c is set to 0 in S12. Next, in S13, whether or not the value in the counter c is less than the sewing region number N is determined in S13. If so (S13:YES), then in S14, the rectangles R1 to R4 stored in the sewing region memory 34 are investigate and the rectangularcorresponding to the value of the counter c that is, the rectangle in the c-th sewing region of the sewing region memory 34, is set as a rectangle R.

Next, in S15, contour lines, or line shapes when the figure is formed from lines, are determined for a partial figure defined by areas wherein the rectangle R overlaps the overall figure. The contours, line shapes, or both are stored in the partial figure data memory 32. The contour lines and line forms can be determined in S15 using clipping algorithms, which are frequently used in computer graphics. In this case, a clipping window used in clipping algorithms serves as the rectangle R.

If the contour lines and line shapes of the overall figure are straight lines, then the contour lines and line shapes can be determined using polygonal clipping algorithms when the figure is a planar figure and using line segment algorithms can when the figure is a linear figure. In this way, the contour lines and line shapes of the partial figures can be determined. When the contours or line shapes of the subject figure include curved lines, then the curved lines are first converted into line segments that minimum the curved lines and then partial figures including these lines are determined using the above-described algorithms.

A variety of line segment clipping algorithms are known, such as Sutherland-Cohen algorithms and Cyrus-Beck algorithms. A variety of polygonal clipping algorithms are known, such as Sutherland-Hodgeman algorithms and Weiler-Atherton algorithms.

Figure 8:
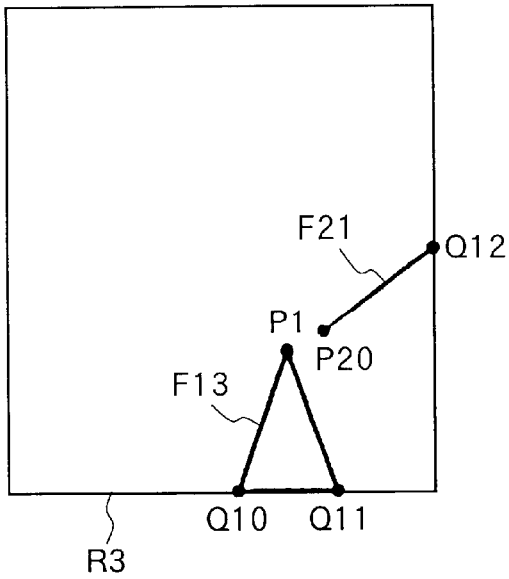
FIG. 8(*a*) is a schematic view showing partial figure data obtained by clipping the figure data based on the sewing region R3 shown in FIG. 7.
Figure 8:
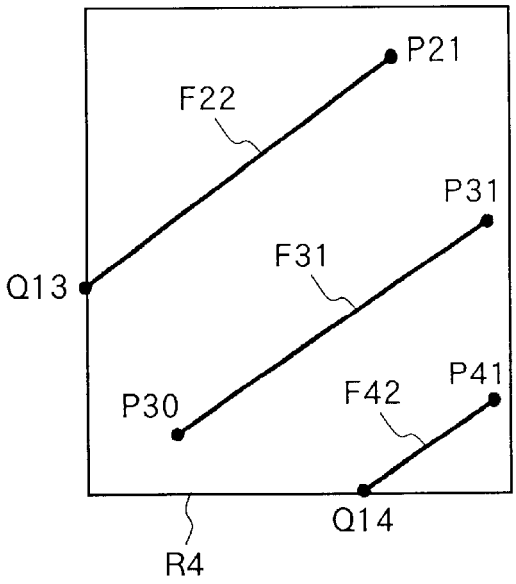
Figure 8:
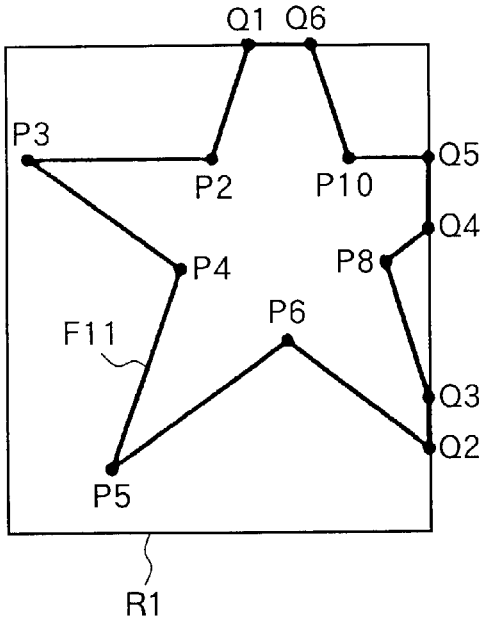
Figure 8:
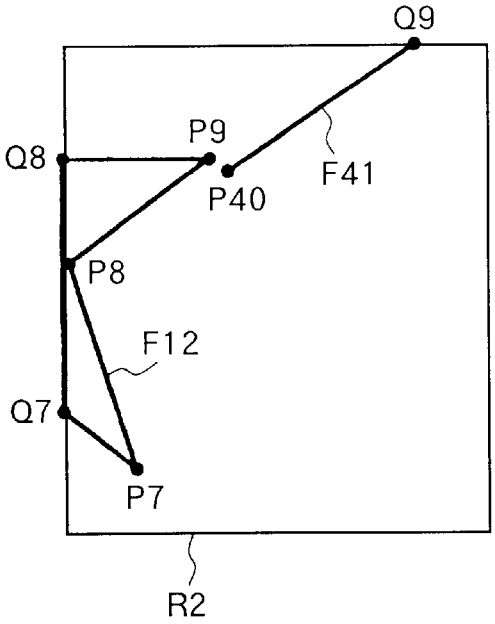

In the present embodiment, the partial figure data shown in FIGS. 8(*a*) through 8(*d*) can be prepared by subjecting the data shown in FIG. 5 to the above-described algorithms. That is, when the rectangle R1 is set as the subject rectangle R, then as shown in FIG. 8(*c*) the partial figure F11 is prepared by clipping the figures F1 through F4 based on the rectangle R1. Then, data for the partial figure F11 is stored in the partial figure data memory 32. When the rectangle R2 is set as the subject rectangle R, then as shown in FIG. 8(*d*), the partial figures F12 and F41 are prepared by clipping the figures F1 through F4 based on the rectangle R1. Then, data for the partial figures F12 and F41 is stored in the partial figure data memory 32. Further, when the rectangle R3 is set as the subject rectangle R, then as shown in FIG. 8(*a*) the partial figures F13 and F21 are prepared by clipping the figures F1 through F4 based on the rectangle R1. Then, data for the partial figures F13 and F21 is stored in the partial figure data memory 32. When the rectangle R4 is set as the subject rectangle R, then as shown in FIG. 8(*b*) the partial figures F22, F31, and F42 are prepared by clipping the figures F1 through F4 based on the rectangle R4. Then, data for the partial figures F22, F31, which is the same as figure F13, and F42 is stored in the partial figure data memory 32.

Next in S16, data for the partial figures is developed into embroidery data and stored in the c-th area of the embroidery data memory 33. Embroidery data is prepared in S16 using well-known embroidery data preparation techniques for preparing embroidery data from contour line data and line shape data. The embroidery data is used for embroidery stitches used to sew lines of polygonal shapes. For example, in one well known method, embroidery stitch data is prepared from contour line data. The embroidery blocks are then filled in using stitches that alternate between and connect the opposing contour lines defining each embroidery block. In another well-known method, embroidery stitches can be prepared also from line shape data of linear figures. In this method, data for running or is prepared for each line segment represented by the line shape data.

Figure 9:
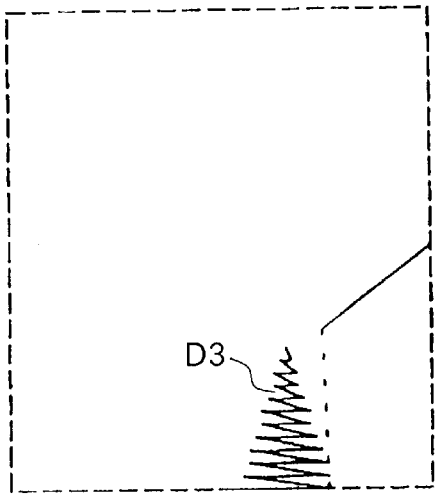
FIG. 9(*a*) is a schematic view showing embroidery data prepared from the partial figure data shown in FIG. 8(*a*)
Figure 9:
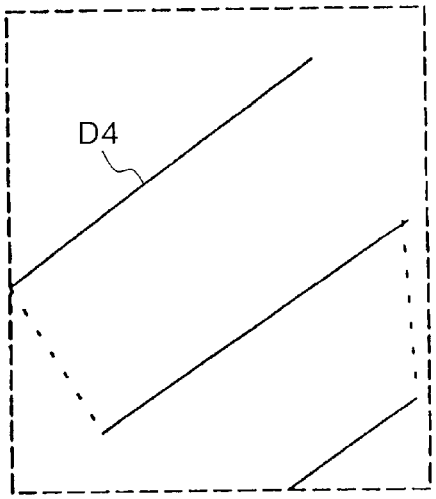
Figure 9:
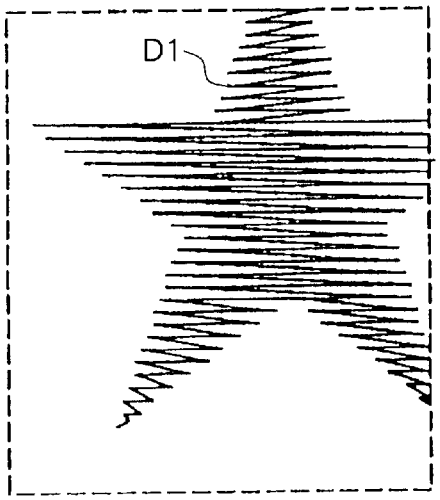
Figure 9:
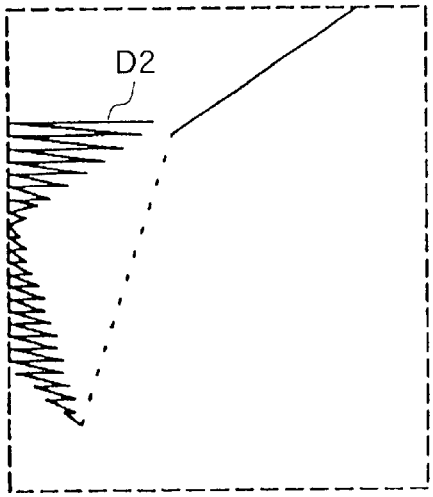

By using these processes to prepare embroidery data from the partial figures, then, for example, the embroidery data D1 to D4 shown in FIGS. 9(*a*) to 9(*d*) is prepared from the partial figure data shown in FIGS. 8(*a*) to 8(*d*) and the sets of embroidery data D1 to D4 are stored in separate areas of the embroidery data memory 33. It should be noted that the rectangles encompassed by the broken lines in FIGS. 9(*a*) to 9(*d*) indicate masks for the embroidery data. The solid lines within the rectangles indicate stitches. The dotted lines indicate feed operations performed when the needle and the workpiece cloth are moved with respect to each other without any stitches being sewn. The embroidery sewing machine uses these to embroidery each embroidery pattern into a separate cloth. The user can then sew the separate pieces of cloth together to produce an embroidery in the original size of the original figure. By sewing adjacent pieces of cloth together with the adjacent partial figures overlapping each other, the embroidery of the overall figures can be reproduced without spaces showing between adjacent partial figures.

Next, the counter c is incremented by one in S17 and the routine proceeds to S13. When the value in the counter c is no longer smaller than the value in the counter N (S13:NO), then the embroidery data preparation routine is ended.

Although according to the present embodiment, the sewing data preparation program and the sewing region setting program are prestored in the ROM 21 of the embroidery data processor, this is not a limitation of the present invention. For example, these programs could be stored in a floppy disk, a hard disk, or a CD-ROM. The programs could then be retrieved, installed, and operated as needed. Alternatively, these programs could be retrieved from an external information processor using a wireless or a cable transmission unit and operated as needed. In this case, the floppy disk, the hard disk, the CD-ROM, the external information processor, or other memory that stores the programs serves as a memory medium of the present invention.

While the invention has been described in detail with reference to specific embodiments thereof, it would be apparent to those skilled in the art that various changes and modifications may be made therein without departing from the spirit of the invention, the scope of which is defined by the attached claims. For example, in the embodiment the sewing machine setting routine was described as automatically calculating the sewing region from the maximum sewing size of the sewing machine and a rectangle encompassing the subject figure. However, the user can use the mouse 4 or the keyboard 3 to set the sewing region. In this case, the sewing region setting routine can be used to check whether the set size of the sewing region exceeds the maximum sewing size of the sewing machine, whether a plurality of the set sewing region covers the entire overall figure, and whether the set sewing region includes overlapping sections between adjacent sewing regions. Only sewing regions that pass this check are then stored in the sewing region memory 34.

Further, the embodiment described the sewing region set by the sewing region setting routine as a standard rectangle, wherein the sides are parallel to the x and y axes of the sewing machines coordinates system. However, the sewing region can he an optional polygonal shape. As long as the size of the smallest standard rectangle that encompasses the polygonal shape does not exceed the maximum size of the embroidery sewing machine, partial figures can be determined using clipping algorithms wherein the clipping window is the polygonal shape. Embroidery data can be prepared that can be sewn by the embroidery sewing machine.

What is claimed is:

1. An embroidery data processor for preparing embroidery data based on figure data representing an embroidery pattern wherein an embroidery sewing machine forms an embroidery based on the embroidery data, the embroidery sewing machine having a maximum sewing size, the embroidery data processor comprising:

sewing region setting means for setting size of a sewing region so that the sewing region does not exceed the maximum sewing size of the embroidery sewing machine;

embroidery data preparation means for preparing a piece of embroidery data corresponding to a partial embroidery encompassed by the sewing region set by said sewing region setting means; and embroidery data storage means for storing the piece of embroidery data.

2. The embroidery data processor according to claim 1, wherein said sewing region setting means sets at least two sewing regions so that size of each of the at least two sewing regions does not exceed the maximum sewing size of the sewing machine, wherein said embroidery data preparation means prepares, for each of the at least two sewing regions, a corresponding piece of embroidery data corresponding to a partial embroidery pattern encompassed by a corresponding sewing region, and wherein said embroidery data storage means stores at least two pieces of embroidery data corresponding to the at least two sewing regions in different storage regions.

3. The embroidery data processor according to claim 2, wherein each of the at least two sewing regions covers a portion of the embroidery pattern represented by the figure data.

4. The embroidery data processor according to claim 3, wherein each of the at least two sewing regions has an overlapping section that overlaps an adjacent sewing region.

5. The embroidery data processor according to claim 1, wherein the figure data represents at least one of a contour line of a planar embroidery pattern and a line of a linear embroidery pattern.

6. An embroidery data processor for preparing embroidery data based on figure data representing an embroidery pattern wherein an embroidery sewing machine forms an embroidery based on the embroidery data, the embroidery sewing machine having a maximum sewing size, the embroidery data processor comprising:

determining means for determining size of the embroidery pattern;

dividing means for dividing the embroidery pattern into a plurality of sewing regions based on the maximum sewing size so that each of the plurality of sewing regions does not exceed the maximum sewing size;

pattern recognition means for recognizing a piece of embroidery pattern encompassed by each of the plurality of sewing regions;

developing means for developing the piece of embroidery pattern recognized by said pattern recognition means into a piece of embroidery data; and embroidery data storage means for storing the piece of embroidery data developed by said developing means.

7. The embroidery data processor according to claim 6, wherein the size of the embroidery pattern is represented by a size of a rectangle that encompasses the embroidery pattern.

8. The embroidery data processor according to claim 7, wherein said determining means determines the size of the embroidery pattern so as to be a size larger than a minimum size of a rectangle that encompasses the embroidery pattern.

9. The embroidery data processor according to claim 7, wherein the size of the embroidery pattern is determined on an x–y coordinate system.

10. The embroidery data processor according to claim 7, wherein each of the plurality of sewing regions has an overlapping section that overlaps an adjacent sewing region.

11. The embroidery data processor according to claim 7, wherein the figure data represents at least one of a contour line of a planar embroidery pattern and a line of a linear embroidery pattern.

12. A method of preparing embroidery data based on figure data representing an embroidery pattern wherein an embroidery sewing machine forms an embroidery based on the embroidery data, the embroidery sewing machine having a maximum sewing size, the method comprising the steps of:

embroidery data processor comprising:

setting size of a sewing region so that the sewing region does not exceed the maximum sewing size of the embroidery sewing machine;

preparing a piece of embroidery data corresponding to a partial embroidery pattern encompassed by the sewing region set by said sewing region setting means; and storing the piece of embroidery data.

13. The method according to claim 12, wherein the step of setting size of a sewing region sets at least two sewing regions so that size of each of the at least two sewing regions does not exceed the maximum sewing size of the sewing machine, wherein the step of preparing a piece of embroidery data prepares, for each of the at least two sewing regions, a corresponding piece of embroidery data corresponding to a partial embroidery pattern encompassed by a corresponding sewing region, and wherein the step of storing stores at least two pieces of embroidery data corresponding to the at least two serving regions in different storage regions.

14. The method according to claim 13, wherein each of the at least two sewing regions covers a portion of the embroidery pattern represented by the figure data.

15. The method according to claim 14, wherein each of the at least two sewing regions has an overlapping section that overlaps an adjacent sewing region.

16. The method according to claim 12, wherein the figure data represents at least one of a contour line of a planar embroidery pattern and a line of a linear embroidery pattern.

17. A method of preparing embroidery data based on figure data representing an embroidery pattern wherein an embroidery sewing machine forms an embroidery based on the embroidery data, the embroidery sewing machine having a maximum sewing size, the method comprising the steps of:

determining size of the embroidery pattern;

dividing the embroidery pattern into a plurality of sewing regions based on the maximum sewing size so that each of the plurality of sewing regions does not exceed the maximum-sewing size;

recognizing a piece of embroidery pattern encompassed by each of the plurality of sewing regions;

developing the piece of embroidery pattern into a piece of embroidery data; and storing the piece of embroidery data.

18. The method according to claim 17, wherein the size of the embroidery pattern is represented by a size of a rectangle that encompasses the embroidery pattern.

19. The method according to claim 18, wherein the size of the embroidery pattern is determined so as to be a size larger than a minimum size of a rectangle that encompasses the embroidery pattern.

20. The method according to claim 18, wherein the size of the embroidery pattern is determined on an x–y coordinate system.

21. The method according to claim 18, wherein each of the plurality of sewing regions has an overlapping section that overlaps an adjacent sewing region.

22. The method according to claim 18, wherein the figure data represents at least one of a contour line of a planar embroidery pattern and a line of a linear embroidery pattern.

23. A storage medium for storing a program for operating an embroidery data processor that prepares embroidery data based on figure data representing an embroidery pattern wherein an embroidery sewing machine forms an embroidery based on the embroidery data, the embroidery sewing machine having a maximum sewing size, the program comprising:

a program of setting size of a sewing region so that the sewing region does not exceed the maximum sewing size of the embroidery sewing machine;

a program of preparing a piece of embroidery data corresponding to a partial embroidery pattern encompassed by the sewing region set by said sewing region setting means; and a program of storing the piece of embroidery data.

24. The storage medium according to claim 23, wherein the program of setting size of a sewing region is for setting at least two sewing regions so that size of each of the at least two sewing regions does not exceed the maximum sewing size of the sewing machine, wherein the program of preparing a piece of embroidery data is for preparing, for each of the at least two sewing regions, a corresponding piece of embroidery data corresponding to a partial embroidery pattern encompassed by a corresponding sewing region, and wherein the program of storing is for storing at least two pieces of embroidery data corresponding to the at least two sewing regions in different storage regions.

25. The storage medium according to claim 24, wherein each of the at least two sewing regions covers a portion of the embroidery pattern represented by the figure data.

26. The storage medium according to claim 25, wherein each of the at least two sewing regions has an overlapping section that overlaps an adjacent sewing region.

27. The storage medium according to claim 23, wherein the figure data represents at least one of a contour line of a planar embroidery pattern and a line of a linear embroidery pattern.

28. A storage medium for storing a program for operating an embroidery data processor that prepares embroidery data based on figure data representing an embroidery pattern wherein an embroidery sewing machine forms an embroidery based on the embroidery data, the embroidery sewing machine having a maximum sewing size, the program comprising:

a program of determining size of the embroidery pattern;

a program of dividing the embroidery pattern into a plurality of sewing regions based on the maximum sewing size so that each of the plurality of sewing regions does not exceed the maximum sewing size;

a program of recognizing a piece of embroidery pattern encompassed by each of the plurality of sewing regions;

a program of developing the piece of embroidery pattern into a piece of embroidery data; and a program of storing the piece of embroidery data.

29. The storage medium according to claim 28, wherein the program of determining contains a program of representing a size of a rectangle than encompasses the embroidery pattern as the size of the embroidery pattern.

30. The storage medium according to claim 29, wherein the program of determining contains a program of determining the size of the embroidery pattern to be a size larger than a minimum size of a rectangle that encompasses the embroidery pattern.

31. The storage medium according to claim 29, wherein the program of determining contains a program of determining the size of the embroidery pattern on an x–y coordinate system.

32. The storage medium according to claim 29, wherein the program of dividing contains a program of dividing the embroidery pattern into the plurality of sewing regions so that each of the plurality of sewing regions has an overlapping section that overlaps an adjacent sewing region.

33. The storage medium according to claim 29, wherein the figure data represents at least one of a contour line of a planar embroidery pattern and a line of a linear embroidery pattern.

* * * * *